United States Patent [19]

Shackelford et al.

[11] Patent Number: 4,485,585

[45] Date of Patent: Dec. 4, 1984

[54] MULTIPLE-POST TOY STACKER ASSEMBLY

[75] Inventors: Wendell Shackelford, Warren, N.J.; Dwight G. Watkins, Youngstown, Ohio

[73] Assignee: Childcraft Education Corporation, Edison, N.J.

[21] Appl. No.: 374,057

[22] Filed: May 3, 1982

[51] Int. Cl.[3] ..... A63H 33/00

[52] U.S. Cl. ..... 446/117; 434/258

[58] Field of Search ..... 46/16, 1 R; 273/153 P, 273/276, 150; 434/169, 258, 259

[56] References Cited

U.S. PATENT DOCUMENTS

| | | | |
|---|---|---|---|
| 2,424,169 | 7/1947 | Hoffman | 434/169 |
| 3,849,912 | 11/1974 | Kemnitzer | 46/16 X |
| 3,924,859 | 12/1975 | Kramer | 273/150 X |

FOREIGN PATENT DOCUMENTS

| | | | |
|---|---|---|---|
| 23477 | of 1915 | United Kingdom | 273/153 P |

OTHER PUBLICATIONS

"Thing Ding" Schaper Game Catalog 1966.

*Primary Examiner*—Mickey Yu

*Attorney, Agent, or Firm*—Michael Ebert

[57] ABSTRACT

A toy stacker assembly for pre-school children which inspires players to improve their skills in regard to size and color discrimination, hand-eye coordination and in other respects vital to proper childhood development. The toy is constituted by a multiple post ring stacker operating in conjunction with a series of cards each displaying a different pattern of rings of various colors and sizes stacked on the posts. The player is required to replicate the pattern of the selected card on display, the cards in the series presenting progressively more difficult patterns.

4 Claims, 4 Drawing Figures

Fig. 1.
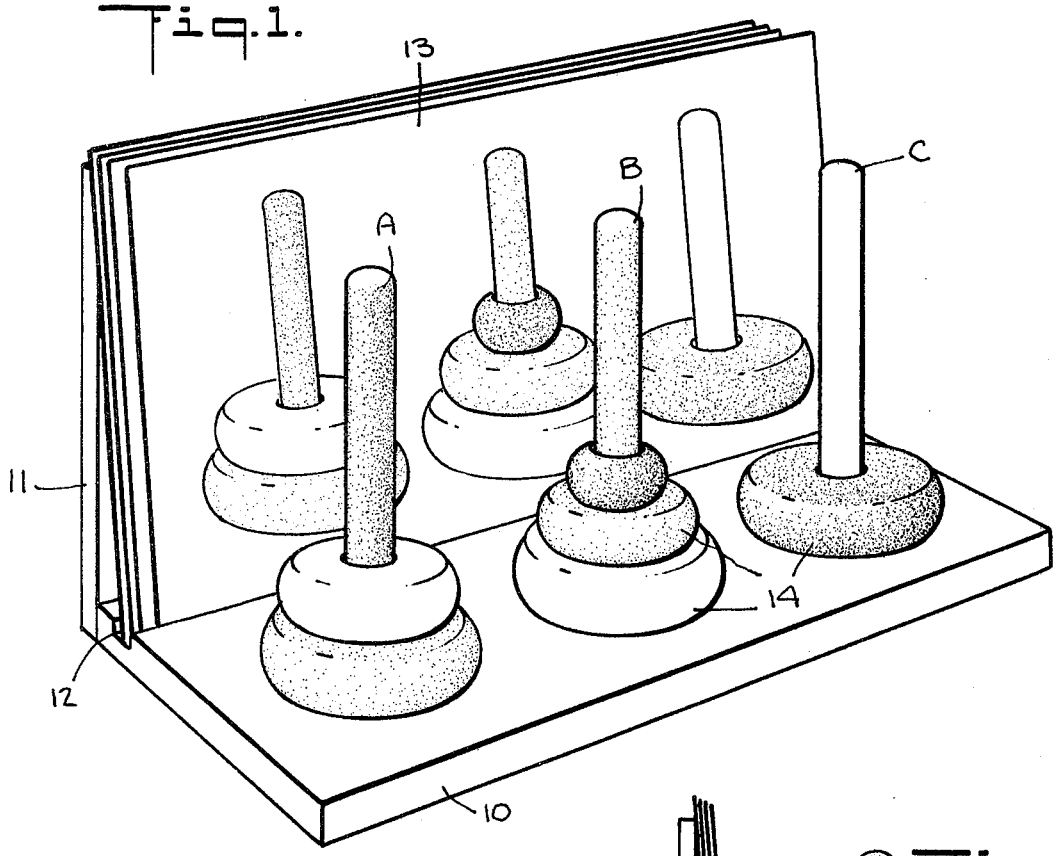
Fig. 2.
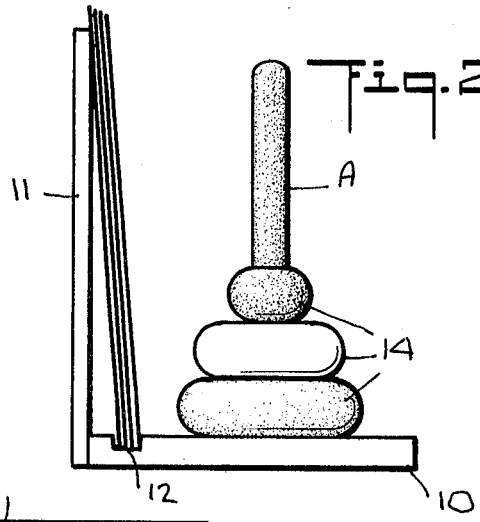
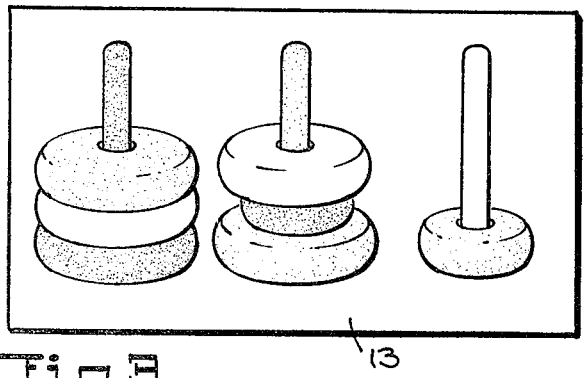
Fig. 3.
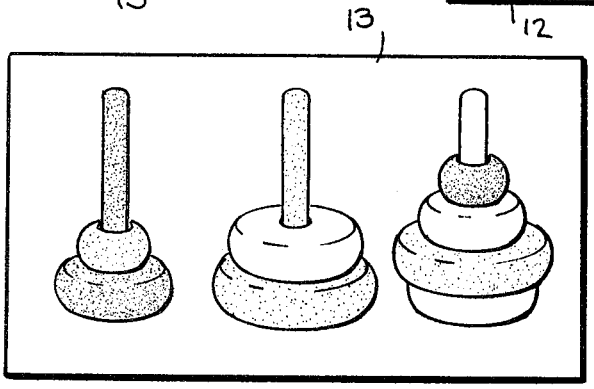
Fig. 4.

MULTIPLE-POST TOY STACKER ASSEMBLY

BACKGROUND OF INVENTION

This invention relates generally to stacker toys in which rings of different size are stacked on a vertical post, and more particularly to a multiple post ring stacker which is operated in conjunction with a series of pattern cards each displaying a different pattern of rings of various sizes and colors stacked on the post, the player being required to replicate the pattern of the selected card on display.

Toys and games designed for pre-school children fall into a special class, for such devices must take into account the ability of players in this age group to manipulate the play elements involved. And while many new toy and game concepts have been introduced in recent years for the pre-school market, the essential nature of the traditional ring stacking post has remained unchanged.

A conventional stacking toy consists of a single vertical post anchored on a base and a set of differently colored doughnut-like play element or rings of progressively increasing diameter, all having a hole on the same size. The player is called upon to stack the rings in the post, one above the other to create a conical form. If, therefore, the player places a ring of a given diameter above one of smaller diameter, the desired form is not created thereby.

The traditional single post stacker has enjoyed lasting popularity and now has the status of a classic. Yet this toy leaves much to be desired in terms of its pre-school educational and training value, and in developing basic skills.

Thus while the player is required to discriminate between rings of different diameter in order to produce a conical form, the different colors of the rings do not come into play in creating this form but only serve a decorative function. And because the typical player is able to quickly master the required sequence of rings on the post, his interest in this toy is generally short-lived; for once mastered, the toy offers little challenge to the child.

SUMMARY OF INVENTION

In view of the foregoing, the main object of this invention is to provide a toy or game constituted by a multiple post ring stacker operating in conjunction with a series of cards or picture frames, each displaying a different pattern of rings of various colors and sizes stacked on the posts, the player being required to replicate the pattern of the card on display.

More particularly, an object of this invention is to provide a stacker of the above type in which the several posts are anchored on a base having a back rest against which lie the series of cards, the first in the series being on display behind the posts, the displayed card illustrating a given pattern in the same scale as the actual three-dimensional ring pattern which the player is required to set up on the posts. Hence the player is able to compare and match the pattern he creates with that on the display.

A significant feature of a ring stacker toy in accordance with the invention apart from its play value is that it functions effectively as a teaching and learning tool which leads children to sharpen their skills in the following areas crucial to proper childhood development.

A. Hand-eye coordination;
B. Visual and tactile shape/size discrimination;
C. Logic sequencing;
D. Color matching and discrimination;
E. Visual memory;
F. Expressive and receptive oral language.

Yet another object of the invention is to provide a toy of the above type which though relatively complex as compared to a single post ring stacker, still lies well within the normal capabilities of pre-school children and which offers a continuing challenge that maintains the player's interest in the toy.

Also an object of the invention is to provide a safe and useful multiple post ring stacker assembly which may be mass-produced at relatively low cost.

Briefly stated, these objects are attained in a multiple-post stacker toy in which at least two posts are anchored in a rectangular base having a vertical backrest and a longitudinal channel running adjacent the backrest to accommodate a stack of cards which lean thereagainst. Each card in the stack has printed thereon a full scale representation of a different pattern of rings stacked on the posts, the rings being in various sizes and colors.

Also provided are playing rings adapted to be stacked on the posts, the number of rings and their colors and sizes being sufficient to replicate any one of the several patterns displayed on the cards.

The outermost card in the stack is displayed behind the posts and the player is required to place rings on the posts to replicate the displayed pattern whereby the card pattern is then a mirror image of the actual pattern. Upon completion of this task, the displayed card is removed to expose the next card pattern for replication, the cards in the series thereof presenting progressively more difficult patterns to the player.

OUTLINE OF DRAWINGS

For a better understanding of the invention as well as other objects and further features thereof, reference is made to the following detailed description to be read in conjunction with the accompanying drawings, wherein:

FIG. 1 illustrates, in perspective, a multiple post ring stacker assembly in accordance with the invention;

FIG. 2 is a side view of the stacker;

FIG. 3 shows one of the cards in the assembly;

FIG. 4 shows another card in the assembly.

DESCRIPTION OF INVENTION

Referring now to FIG. 1, there is shown an assembly in accordance with the invention, the assembly including a rectangular base board 10 having an upright backrest 11 to define a right-angle structure. Running along the rear of the base board adjacent the backrest is a shallow channel 12 whose width is sufficient to accommodate a stack of rectangular cards 13. The length of the cards is about the same as that of the baseboard and the height approximates that of the backrest.

Anchored on baseboard 10 at equi-spaced positions thereon are three posts A, B and C which are differently colored. By way of example, post A is blue, post B is red and post C is yellow.

The playing elements 14 which are to be stacked on these posts are in various sizes and colors, each element being in the form of a doughnut-shaped ring whose hole is slightly larger than the diameter of the posts. Thus the rings are easily fitted on the posts, the bottom ring resting in the baseboard and the succeeding rings being stacked thereover.

In FIG. 1, it will be seen that the rings come in three sizes: small medium and large; and in three colors: red, blue and yellow. But this is for purposes of illustration only, for in practice a greater variety of colors and sizes may be used.

Each card in the series thereof stacked behind the posts carries a picture of a given stacking pattern. In FIG. 1, it will be seen that the outermost card 13 lies behind the posts and is exposed to the viewer, the pattern displayed on this card being a large red and medium yellow ring on post A; a large yellow, medium red and small blue ring on post B, and a large blue ring on post C.

To play with the stacker assembly, the player observing the pattern on the card on display, must replicate this pattern in three dimensions on the stacker posts. Thus FIG. 1 shows a successful completion of this challenge, for the pattern of rings on the stacker matches that on the card which is a mirror image thereof, the pattern on the card being in the same scale as the replicated pattern.

The set of cards 13 carry a series of different stacking patterns of progressively greater complexity so that when the player has successfully matched one card, he is then presented with a more difficult pattern to match. As many playing rings are provided with the assembly as it is necessary to match any pattern in the set.

While the pattern on each card represents a mirror image of the pattern of stacked rings erected by the player, this is true only if the player has succeeded in matching the card pattern. Thus the player observes the arrangement on the two-dimensional pattern card and replicates it in three dimensions, using the card as a visual check. What the player's hand does must, of course, be coordinated with what he sees; and in playing this game the player exercises and improves his eye-hand coordination. The player also learns to discriminate in terms of visual and tactile shape-size impressions, as well as with respect to color. And the player must learn not only to put rings on the post of the proper size and color, but also in the proper sequence to effect a match with the card pattern.

The assembly also lends itself to teacher cooperation; for instead of self play, a teacher may participate by showing the player a selected pattern card for a limited time, say, for 30 seconds, and then conceal the card before asking the player to replicate the pattern on the posts. This procedure serves to exercise and enhance the visual memory of the player.

And to improve oral language and listening skills, a teacher or parent may arrange for another child to look at a pattern card and then describe to a playing child who cannot see the card, the steps necessary to replicate the viewed pattern, the player then seeking to follow the oral instructions as best he can. At the end of this procedure which involves a teacher and two children, the player card is returned to its backrest position as a one-to-one visual check. Again, it is to be noted that this game is on a pre-school level, and the term "teacher" as used herein refers to any participating guide. Thus the assembly when used in this fashion facilitates expressive and receptive oral language development.

This invention is not limited to the use of cards to display stacking patterns to be matched by the player; for in practice this pattern may appear on pictures or frames carried on a web or film advanced by a suitable mechanism to display the patterns in sequence.

While there has been shown and described a preferred embodiment of a multiple-post toy stacker assembly in accordance with the invention, it will be appreciated that many changes and modifications may be made therein without, however, departing from the essential spirit thereof. Thus while the rings are shown as round in form, in practice, they may be in cubical, triangular or any other three-dimensional geometric form, as long as their center holes match the diameter of the posts.

I claim:

1. A toy stacker assembly comprising:

A. a baseboard having a plurality of posts anchored thereon at equi-spaced positions along a single straight line and a back rest parallel to the line;

B. a plurality of rings of different size and color which fit on the posts in any desired sequence to create a stack of rings on each post whose pattern depends on the size and color of these rings and the sequence in which the rings are stacked on the post; and C. a series of colored pictures each showing the same posts with a stack of rings on each post of different size and color in a predetermined pattern, thereby forming a set of patterns, each picture displaying a different set of patterns, whereby a selected picture may be displayed to a player who is then required to replicate on the posts the set of patterns displayed thereby, said pictures appearing on cards each containing a respective picture, which cards are placeable behind the posts at a position parallel to the line wherein the set of patterns on the cards are in the same scale as the set of patterns created by the player on the posts to provide a mirror image thereof when the card is displayed is placed behind the posts, said cards lying against said backrest, said baseboard having a longitudinal channel to accommodate the cards.

2. An assembly as set forth in claim 5, wherein there are three posts, and said rings are in three sizes and three colors.

3. An assembly as set forth in claim 1, wherein said rings have a doughnut configuration.

4. An assembly as set forth in claim 1, wherein at least one of the rings has a non-circular form.

* * * * *

UNITED STATES PATENT OFFICE

CERTIFICATE OF CORRECTION

Patent No. 4,485,585 Dated March 11, 1985

Inventor(s) Wendell Shackelford et al.

It is certified that error appears in the above-identified patent and that said Letters Patent are hereby corrected as shown below:

Column 4, line 47: delete "is" between "card" and "displayed".

Signed and Sealed this

*Twenty-fifth* Day of *June 1985*

[SEAL]

*Attest:*

DONALD J. QUIGG

*Attesting Officer* *Acting Commissioner of Patents and Trademarks*